US006189453B1

(12) United States Patent
Lin

(10) Patent No.: US 6,189,453 B1
(45) Date of Patent: Feb. 20, 2001

(54) STRUCTURE OF A SMOKE GENERATOR

(76) Inventor: Yu-Chuan Lin, 1F, No.101, San Yang Road, San Chung City, Taipei Hsien (TW)

( * ) Notice: Under 35 U.S.C. 154(b), the term of this patent shall be extended for 0 days.

(21) Appl. No.: 09/330,184

(22) Filed: Jun. 11, 1999

(51) Int. Cl.[7] ..... F42B 12/48; C06D 3/00; C06D 5/00; F22B 1/28; F22B 29/06

(52) U.S. Cl. ..... 102/334; 102/530; 102/531; 392/394; 392/397

(58) Field of Search ..... 102/334, 530, 102/531; 392/394, 397

(56) References Cited

U.S. PATENT DOCUMENTS 5,344,319 * 9/1994 Manzke ..... 102/334
5,870,524 * 2/1999 Swiatosz ..... 102/334

* cited by examiner

*Primary Examiner*—Charles T. Jordan
*Assistant Examiner*—Glenda L. Sánchez
(74) *Attorney, Agent, or Firm*—Dougherty & Troxell

(57) ABSTRACT

An improved structure of a smoke generator including a housing and a pump accommodated in the housing. The pump pumps a chemical solution in a container via a solution duct to a heating vaporization device. The heating vaporization device includes two opposed disposed heat insulation rings, a heating tube, and a power source. The heat insulation rings are metal rings of good electrical conductivity and have a periphery provided with a plurality of ring holes. A plurality of metal conductive wires each have two ends respectively connected to the opposedly arranged ring holes, with a coil formed in a center of each heat insulation ring. The heating tube is a metal tube of a high resistance coefficient and is mounted intermediate of the heat insulation rings. A solution inlet and a smoke ejecting end at both ends of the heating tube pass through and are secured in the coils on the same side. A vaporization section of the heating tube is disposed intermediate of the solution inlet and smoke ejecting end and configured to be winding. The solution inlet receives the solution transported via the solution duct to allow the solution to undergo vaporization in the vaporization section. Smoke formed within the vaporization section is ejected via the smoke ejecting end. The power source is pivotally connected to a circuit board and is further connected to the pump and the heating vaporization device to achieve connection of a control circuit. Two connecting wires of the circuit board are respectively connected to the heat insulation rings so that electric currents pass through the lead wires, coils, and the heating tube therebetween to achieve connection of the circuit. The heating tube forms resistance to generate high temperature that vaporizes the solution flowing therethrough. The smoke thus generated is ejected from the smoke ejecting end.

4 Claims, 5 Drawing Sheets

STRUCTURE OF A SMOKE GENERATOR

BACKGROUND OF THE INVENTION (a) Field of the Invention

The present invention relates to an improved structure of a smoke generator, more particularly to a heating vaporization device of the smoke generator to quickly heat and achieve complete vaporization of a chemical solution.

(b) Description of the Prior Art

In stage performance, smoke can create good visual effects. Smoke effects generally fall into two forms. In the first form, the smoke pervades the air. In the second form, the smoke is low and hangs above the floor of the stage. In general, dry ice is used to create the second form of smoke effect. However, dry ice is expensive.

The first form of smoke effect is indispensable in stage performances. With reference to FIG. 1, a conventional smoke generator generally includes a pump A that is communicates with a container D for storing a chemical solution C via a duct B. The pump A pumps chemical solution C to a heating tank E where the solution C is heated and vaporized to form smoke and mist. The smoke thus generated passes through a nozzle provided on the heating tank E to pervade the air and create the desired visual effect. It can therefore be seen that the function of the heating and vaporization device of the conventional smoke generator is mainly to ensure complete vaporization of the chemical solution and avoid ejection of smoke in the form of droplets that may scald people around or wet the floor, which is dangerous.

The heating tank E shown in FIG. 1 is the subject of R.O.C. Utility Model Pat. No. 119093 to the inventor of the present invention. The heating tank E includes a base E1 internally provided with a base hole E2 and a heating chamber E3. A screw rod E4 is disposed in the base hole E2. A solution duct E5 transports the solution C supplied via the pump A into the base hole E2 so that the solution C travels along the screw rod E4 towards a smoke ejecting device E6 at a front end of the base hole E2. A heating device E7 is provided inside the heating chamber E3 to heat the base hole E2 above. The high temperature thus generated causes the solution C to become vaporized, and the smoke is ejected by the smoke ejecting device E6. The above-described heating and vaporization device can achieve complete vaporization of the solution C. But the heating device E7 must be pre-heated prior to use to a temperature sufficient to vaporize the solution C in order pump the solution C to the base hole E2 for vaporization using the pump A. Such an indirect method of heating is not very satisfactory. Besides, since use of the heating tube is power-consuming, alternating currents are utilized. In outdoor occasions where alternating currents are unavailable, a heating and vaporization device as such cannot be used.

SUMMARY OF THE INVENTION

A primary object of the present invention is to provide an improved structure of a smoke generator equipped with a heating vaporization device to quickly heat and achieve complete vaporization of a chemical solution.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
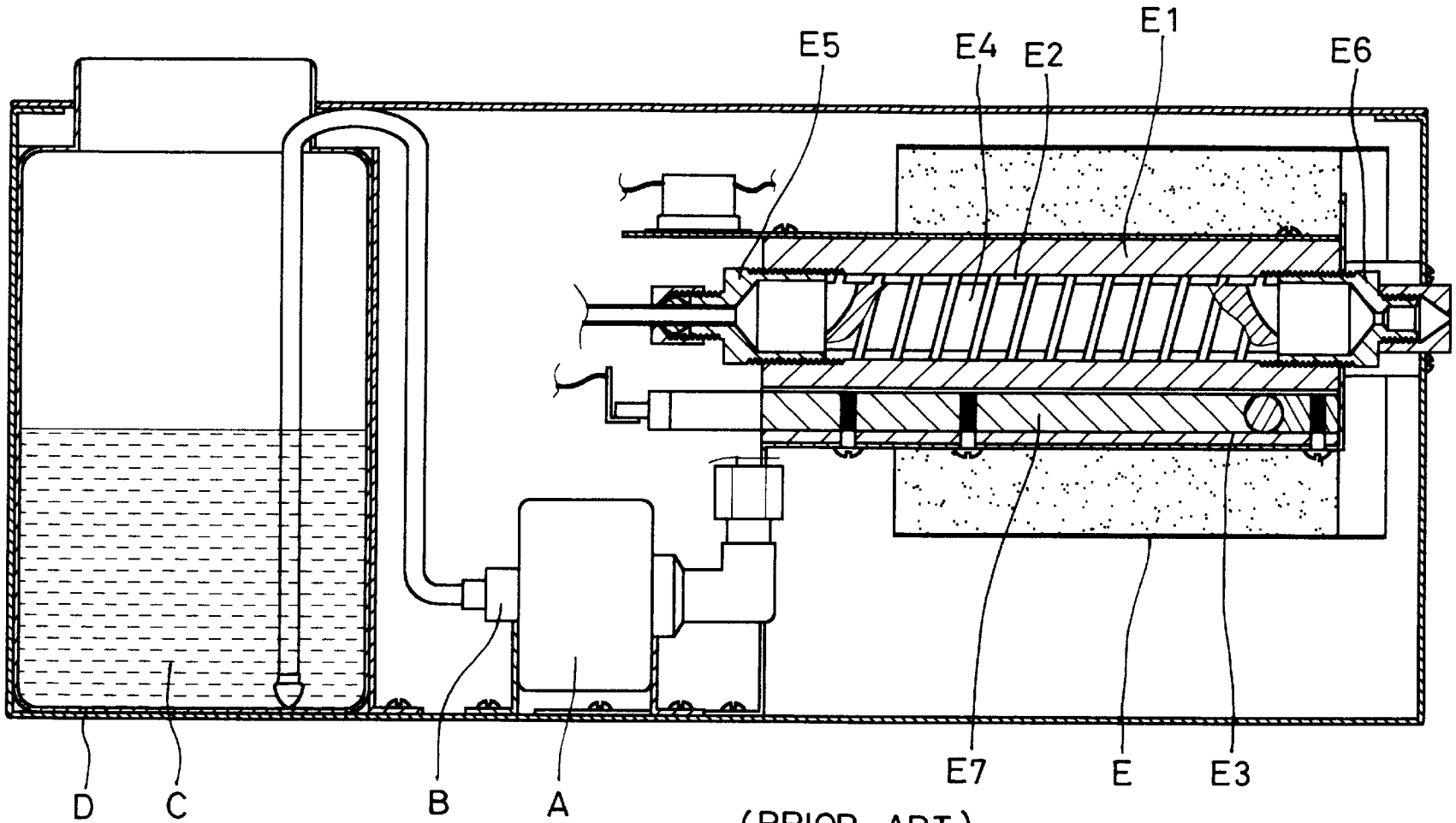
(PRIOR ART) FIG. 1
FIG. 1 is a sectional view of a conventional smoke generator.
Figure 2:
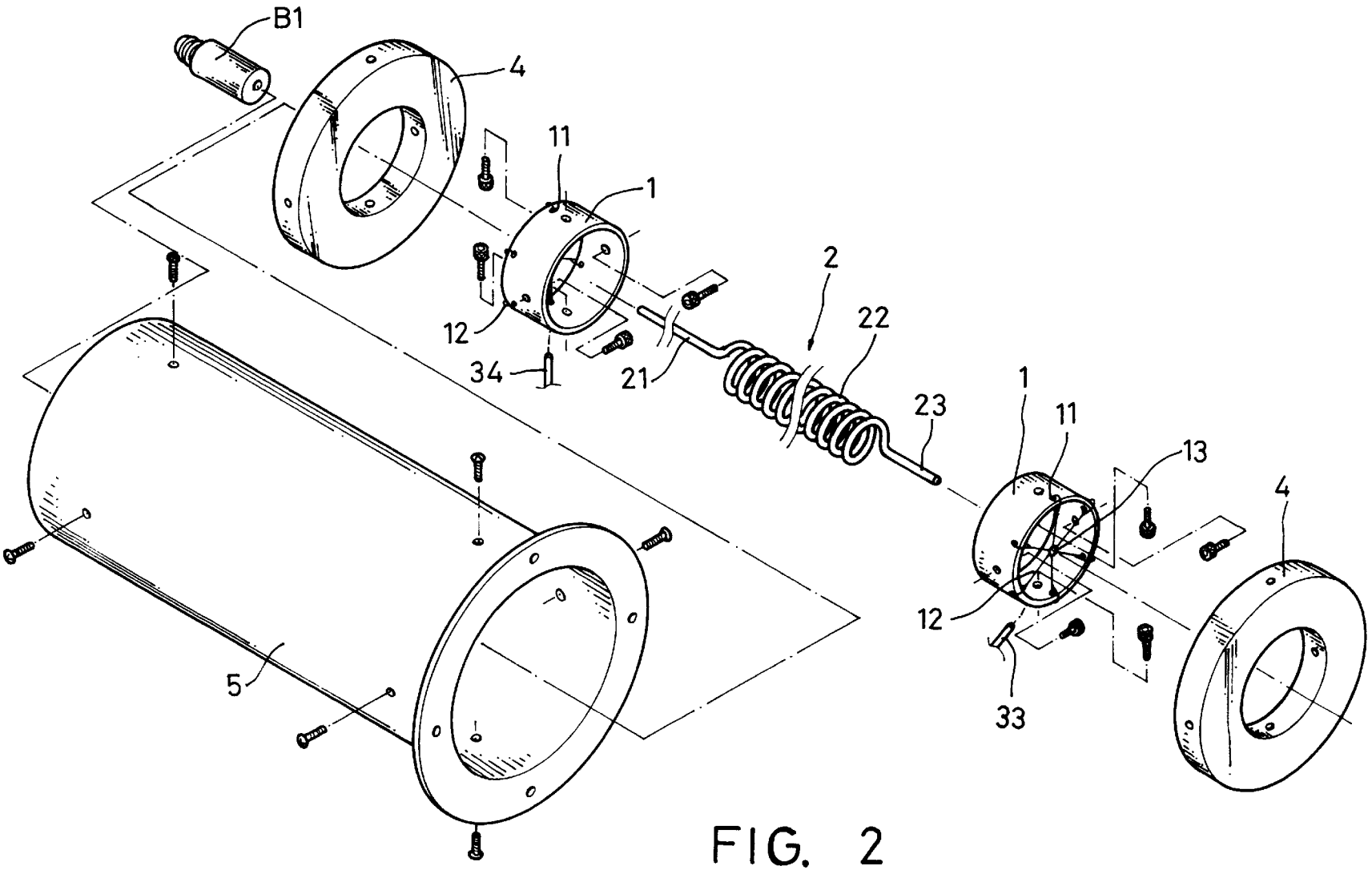
FIG. 2 is an exploded perspective view of a heating vaporization device of the present invention.
Figure 3:
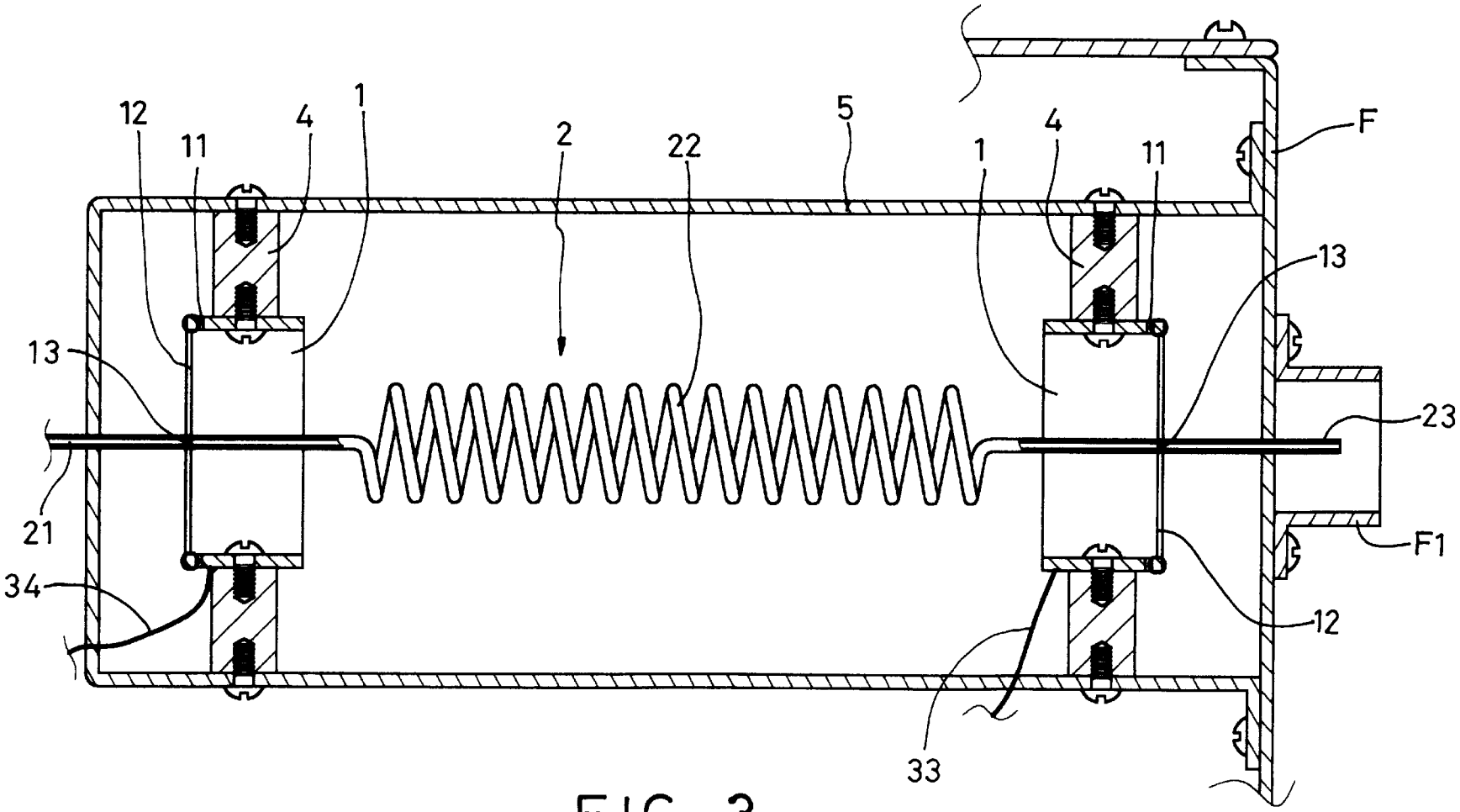
FIG. 3 is a schematic enlarged view of the heating vaporization device of FIG. 2 in part.
Figure 4:
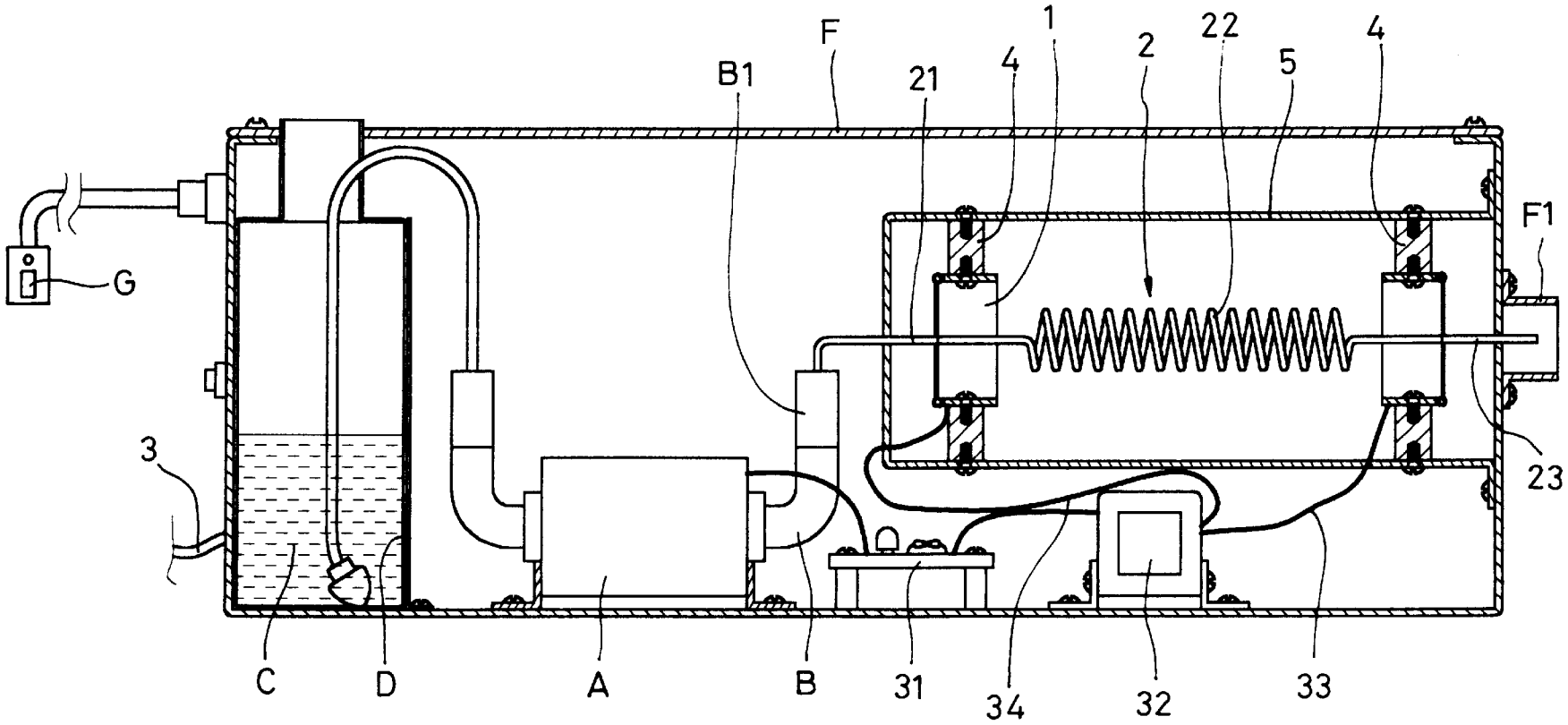
FIG. 4 is an assembled sectional view of the present invention showing the arrangement thereof.
Figure 5:
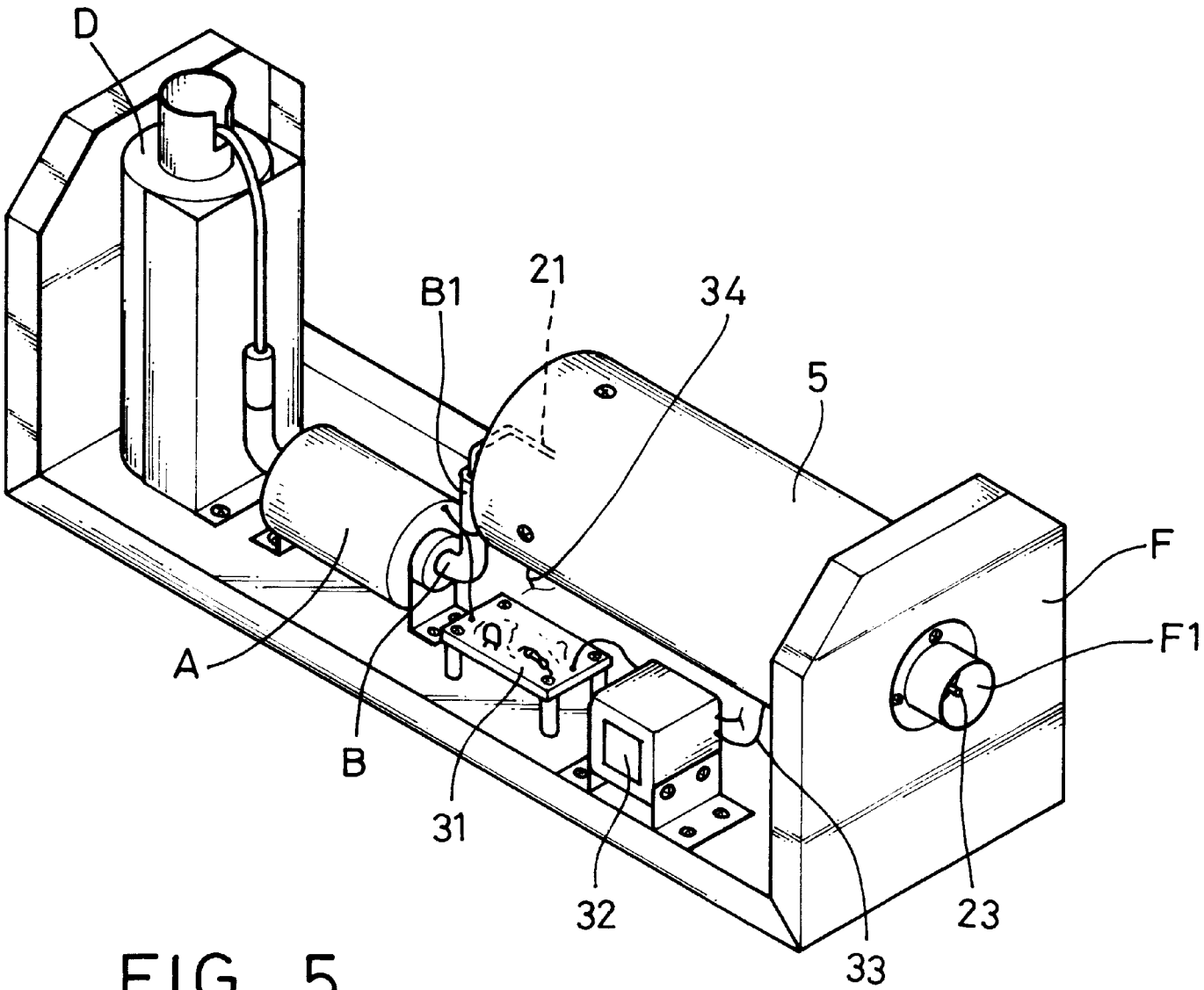
FIG. 5 is an assembled perspective view of the present invention.

With reference to the drawings, the smoke generator of the present invention basically includes a housing F and a pump A accommodated in the housing F. The pump A pumps a chemical solution C in a container via a solution duct B to a heating vaporization device. The heating vaporization device includes a pair of heat insulation rings 1, a heating tube 2, and a power source 3.

The heat insulation rings 1 are metal rings of good electrical conductivity and have a periphery provided with a plurality of ring holes 11. A plurality of metal conductive wires 12 have two ends respectively connected to the opposedly arranged ring holes 11. The center of each heat insulation ring forms a coil 13 for passage and positioning of the heating tube 2.

The heating tube 2 is a metal tube of a high resistance coefficient and is mounted intermediate of the heat insulation rings 1. A solution inlet 21 at one end of the heating tube 2 passes through and is secured in the coil 13 that is on the same side to receive the solution C transported via the solution duct B. The solution C continues to pass through a vaporization section 22 that has a winding middle section. The vaporization section 22 is configured to be winding to increase the length of its path so as to ensure complete vaporization of the solution C. In practice, the vaporization section 22 is preferably spiral. The smoke formed within the vaporization section 22 is ejected via a smoke ejecting end 23. The smoke ejecting end 23 likewise passes through and is secured in the coil 13 on the same side to eject the smoke from a smoke outlet F1 of the housing F.

The power source 3 is a connected to a circuit board 31 and is further connected to the pump A and heating vaporization device to achieve connection of a control circuit. In order to enable the heating tube 2 to achieve resistance, two connecting wires 33, 34 of the circuit 32 are respectively connected to the heat insulation rings 1 so that electric currents pass through lead wires 12, coils 13, and the heating tube 2 therebetween to achieve connection of the circuit. The heating tube 2 will form resistance upon connection of the circuit to generate high temperature that vaporizes the solution C flowing therethrough, and the smoke thus generated is ejected from the smoke ejecting end 23.

As a matter of fact, the electric voltage required by the heating vaporization device of the present invention is quite small. If alternating current is are used as a power source, a voltage converter 32 has to be adopted to convert it into direct currents so that, when the heating tube 2 is connected, the heating tube 2 can generate resistance. The above-mentioned voltage converter 32 can regulate the voltage to 12 volts; however, it should be understood that the present invention can achieve the intended objects without being limited to that voltage value. Furthermore, in view of the aforesaid, those skilled in the art can appreciate that battery cells (providing direct current) can be adopted to supply 12-volt direct current to the heating tube 2. Hence, the present invention can also be used outdoors where alternating current is unavailable.

The above-mentioned circuit board 31 is provided to ensure the smooth operation of the pump A. By controlling the voltage of the pump A and micro-adjusting the value of the voltage, the flow speed of the solution C in the heating 2 can be controlled to match the heating speed. Besides, the circuit board 31 is programmed for control purposes. When a smoke ejecting button G is actuated, the heating tube 2 is pre-heated for a predetermined period of time, for instance, 6 seconds, before the pump A operates. In this manner, the solution C flowing through the heating tube 2 has a sufficient temperature to achieve vaporization. In addition, when pressure on the smoke ejecting button G is released, the pump A will stop pumping the solution C, and the heating tube 2 will stop heating after 3 to 4 seconds to ensure that no solution C is left inside the heating tube 2.

Furthermore, in order that the above-described heating and vaporization device can be secured in the smoke generator, each heat insulation ring 1 is fitted with an insulating ring 4 to ensure that the former cannot get into contact with other electrically conductive objects. The two insulating rings 4 are further inserted into a protective cylinder 5 and secured therein using screws, so that contact with the heating tube 2 is avoided. Finally, the protective cylinder 5 is secured inside the smoke generator by means of conventional connecting and supporting devices.

In actual operation, when the smoke ejecting button G is pressed, a signal is emitted to the circuit board 31, which commands the power source 3 to pass through the voltage converter 32, connecting wires 33, 34, heat insulation rings 1, and lead wires 12 to cause the heating tube 2 to preheat for 6 seconds. Then, the pump A starts pumping the solution C from the container D. The solution is transported via the solution duct B and feed solution connector B1 into the heating tube 2 which has already reached a temperature sufficient for vaporization of the solution C. When the solution C passes through the vaporization section 22 of the heating tube 2, it is completely vaporized into smoke. Finally, the smoke is ejected from the smoke ejecting end 23. To stop ejection of smoke, the pressure on the smoke ejecting button G is released. A signal is emitted to the circuit board 31 to command the pump A to stop pumping the solution C. The heating tube 2 will continue operation for 3 to 4 seconds before coming to a stop so that solution C therein is completely vaporized and ejected from the smoke ejecting end 23.

In the present invention, the conventional indirect heating of the solution is changed to direct heating, and the preheating time is considerably reduced. Furthermore, the construction of the heating tube is simple and the connection of the heat insulation rings is quick. Assembly time and manufacturing costs can be reduced. In particular, the present invention utilizes direct current to supply power to the heating tube to generate resistance and high temperature. When it is desired to use alternating currents instead, it is only necessary to add a voltage converter. If battery cells are used to provide a power source, the connecting wires are directly connected to the heat insulating rings. Hence, the present invention can be used outdoors, which is a vast improvement in the art.

Although the present invention has been illustrated and described with reference to the preferred embodiment thereof, it should be understood that it is in no way limited to the details of such embodiment but is capable of numerous modifications within the scope of the appended claims.

What is claimed is:

1. A vaporization system for a smoke generator having a housing, a pump located in the housing and communicating with a supply of smoke generating solution, the vaporization device comprising:

a) a protective cylinder mounted in the housing;

b) at least two spaced apart, annular insulating rings mounted within the protective cylinder;

c) an electrically conductive ring attached to each of the at least two insulating rings, each electrically conductive ring having a coil supported within the electrically conductive ring by a plurality of electrically conductive lead wires connected to the coil and to the associated electrically conductive ring;

d) an elongated electrically conductive heating tube supported by the coils within the protective cylinder, the heating tube having an inlet end connected to the pump, whereby the smoke generating solution is pumped into the heating tube, and a smoke ejecting end communicating with a smoke outlet of the housing;

e) an electrical power source connected to the pump and the electrically conductive rings so as to supply electric current thereto and to the heating tube via the lead wires and coils to thereby heat the heating tube and smoke generating solution therein to generate smoke; and, f) a control system controlling the electrical power source whereby operation of the pump is delayed for a predetermined time period after electrical power is supplied to the heating tube thereby enabling the heating tube to preheat before pumping the smoke generating solution into the heating tube.

2. The vaporization device for a smoke generator as defined in claim 1 wherein the electrical power source includes a voltage converter to convert alternating current into direct current to thereby allow utilization of alternating current as a power source, connecting wires of said voltage converter being respectively connected to said electrically conductive rings.

3. The vaporization device for a smoke generator as defmed in claim 1 wherein said electrical power source comprises batteries.

4. The vaporization device for a smoke generator as defmed in claim 1 wherein said heating tube has a vaporization section with a spiral configuration.

* * * * *